US007061179B2

(12) United States Patent
Jung et al.

(10) Patent No.: US 7,061,179 B2
(45) Date of Patent: Jun. 13, 2006

(54) PLASMA DISPLAY PANEL HAVING DISCHARGE CELLS SHAPED TO INCREASE MAIN DISCHARGE REGION

(75) Inventors: Eun-Young Jung, Suwon-si (KR); Kyoung-Doo Kang, Suwon-si (KR); Jae-Ik Kwon, Suwon-si (KR)

(73) Assignee: Samsung SDI, Co., Ltd., Suwon-si (KR)

( * ) Notice: Subject to any disclaimer, the term of this patent is extended or adjusted under 35 U.S.C. 154(b) by 49 days.

(21) Appl. No.: 10/962,498

(22) Filed: Oct. 13, 2004

(65) Prior Publication Data

US 2005/0082979 A1 Apr. 21, 2005

(30) Foreign Application Priority Data

Oct. 16, 2003 (KR) ..... 10-2003-0072366

(51) Int. Cl.
*H01J 17/49* (2006.01)

(52) U.S. Cl. ..... 313/582

(58) Field of Classification Search ..... 313/582–587; 315/169.3–169.4; 345/41
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B1 | 3/2004 | Setoguchi et al. |
| 2002/0039003 | A1 * | 4/2002 | Inoue ..... 313/581 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |
| JP | 2005-93155 | * 4/2005 |

* cited by examiner

OTHER PUBLICATIONS

"*Final Draft International Standard*", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Bumsuk Won
(74) *Attorney, Agent, or Firm*—Robert E. Bushnell, Esq.

(57) ABSTRACT

A plasma display panel includes a first substrate and a second substrate arranged to oppose one another with a predetermined gap therebetween. Address electrodes are arranged on the first substrate, and barrier ribs are arranged between the first and second substrates to independently define discharge cells. Phosphor layers are arranged in the discharge cells. Sustain electrodes are arranged on the second substrate along a direction perpendicular to the address electrodes. Each of the discharge cells includes first and second sides arranged along the direction of the address electrodes, and third and fourth sides arranged along the direction of the sustain electrodes. The first and second sides are convexly arranged in a direction away from each other, and the third and fourth sides are concavely arranged.

12 Claims, 4 Drawing Sheets

PLASMA DISPLAY PANEL HAVING DISCHARGE CELLS SHAPED TO INCREASE MAIN DISCHARGE REGION

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on Oct. 16, 2003 and there duly assigned Serial No. 2003-72366.

BACKGROUND OF THE INVENTION

1. Field of the Invention

The present invention relates to a Plasma Display Panel (PDP), and more particularly, to a discharge cell structure of a PDP.

2. Description of the Related Art

A PDP is a display device in which ultraviolet rays generated by the discharge of a gas excite phosphors to realize predetermined images. The PDP is classified according to the voltage application method and electrode structure. The triode surface discharge AC-PDP (Alternating Current-Plasma Display Panel) is becoming the most common type of PDP.

In a triode surface discharge AC-PDP, address electrodes, barrier ribs, and phosphor layers are arranged on a rear substrate, and sustain electrodes comprised of scan electrodes and common electrodes are arranged on a front substrate. The address electrodes and the scan electrodes are covered with a dielectric layer. A discharge gas (typically an Ne—Xe compound gas) is injected into discharge cells formed where the address electrodes intersect the sustain electrodes.

With the application of an address voltage Va between the address electrodes and scan electrodes, discharge cells where illumination is to take place are selected by an address discharge. If a sustain voltage Vs is applied between the scan electrodes and common electrodes of selected discharge cells, a plasma discharge (i.e., a sustain discharge) occurs in the discharge cells. Ultraviolet rays are emitted from excited Ne or Xe atoms generated during the sustain discharge, and the ultraviolet rays excite phosphor layers so that visible light is created to thereby realize the display of color images.

In the PDP operating as described above, the barrier ribs are arranged in a striped pattern or in a closed lattice configuration. With the barrier ribs arranged in a striped pattern, a single discharge cell is defined by the space between two adjacent barrier ribs, and by the intersection of an address electrode and a sustain electrode. In a closed lattice configuration, each of the discharge cells is defined independently by the barrier ribs.

The discharge cells with the above barrier rib structures are formed into rectangular shapes with lengths greater than widths. For each of the discharge cells, a scan electrode and a common electrode for effecting a sustain discharge are uniformly aligned at opposite ends of the particular discharge cell so that a discharge gap is formed between the scan electrode and common electrode in a center area of the discharge cell.

However, a problem with such a configuration is that compared to the overall volume of the discharge cells, the discharge gaps between the scan electrodes and common electrodes, and the main discharge regions opposite the discharge gaps where sustain discharge takes place, are limited in size. As a result, a smooth initialization of discharge is difficult such that it is necessary to increase a drive voltage. Also, it is difficult to realize sufficient wall charges and space charges in the discharge cells such that illumination efficiency is reduced, thereby placing limitations on the overall efficiency of the PDP (i.e., the brightness ratio relative to the amount of power consumed).

SUMMARY OF THE INVENTION

In one exemplary embodiment of the present invention, a plasma display panel is provided that increases a region of a main discharge where a sustain discharge is initiated to thereby enable easy discharge firing, reduced drive voltage, and increased screen brightness such that the PDP efficiency is increased.

In an exemplary embodiment of the present invention, a plasma display panel includes: first and second substrates arranged to oppose one another with a predetermined gap therebetween; address electrodes arranged on a surface of the first substrate to oppose the second substrate; barrier ribs arranged between the first and second substrates in closed configurations to independently define discharge cells; phosphor layers arranged within each of the discharge cells; and sustain electrodes arranged on a surface of the second substrate to oppose the first substrate, the sustain electrodes being arranged perpendicular to the address electrodes; wherein each of the discharge cells includes first and second sides arranged along the direction of the address electrodes, and third and fourth sides arranged along the direction of the sustain electrodes, and wherein the first and second sides are convexly arranged in a direction away from each other and about centers of the discharge cells, and wherein the third and fourth sides are concavely arranged in a direction toward each other and about the centers of the discharge cells.

The first and second sides are preferably arc-shaped in a direction away from centers of the discharge cells, and apexes of the arranged arcs are aligned with the centers of the discharge cells.

The third and fourth sides are preferably arc-shaped in a direction toward centers of the discharge cells, and apexes of the arranged arcs are aligned with the centers of the discharge cells.

The third and fourth sides are preferably arc-shaped in a direction toward centers of the discharge cells, and apexes of the arranged arcs are aligned with the centers of the discharge cells.

The plasma display panel preferably further comprises non-discharge regions arranged between adjacent discharge cells in a direction of the address electrodes. The sustain electrodes preferably include bus electrodes that extend such that each of the discharge cells has a pair of bus electrodes arranged at outer areas thereof, and wherein the sustain electrodes include protrusion electrodes that extend from each of the bus electrodes such that a pair of opposing protrusion electrodes are arranged within areas corresponding to each discharge cell and such that a gap is arranged between each opposing pair of protrusion electrodes.

In another exemplary embodiment of the present invention, a plasma display panel includes: first and second substrates arranged to oppose one another with a predetermined gap therebetween; address electrodes arranged on a surface of the first substrate to oppose the second substrate; barrier ribs arranged between the first and second substrates in closed configurations to independently define discharge cells; phosphor layers arranged within each of the discharge cells; and sustain electrodes arranged on a surface of the second substrate to oppose the first substrate, the sustain electrodes being arranged perpendicular to the address electrodes; wherein each of the discharge cells has a first width along the direction of the sustain electrodes, and a second width along the direction of the address electrodes, and wherein the first width continuously decreases as a distance from a center of the discharge cell is increased, and wherein the second width continuously increases as a distance from the center of the discharge cell is increased.

The plasma display panel preferably further comprises non-discharge regions arranged between adjacent discharge cells in a direction of the address electrodes.

Each of the non-discharge regions is preferably arranged between pairs of adjacent discharge cells along the direction of the address electrodes, and wherein each of the non-discharge regions is defined by a first surface adjacent to one of the discharge cells comprising one of a particular pair of discharge cells, and by a second surface adjacent to the other of the particular pair of discharge cells, the first and second surfaces being convexly arranged in a direction away from each other.

The first and second surfaces are preferably arc-shaped with apexes of the arcs of each of the non-discharge regions being respectively directed toward centers of the corresponding pair of discharge cells.

A width of the non-discharge regions in the direction of the address electrodes is preferably at a maximum at a center area thereof, and decreases steadily away from the center area along the direction of the sustain electrodes.

The sustain electrodes preferably include bus electrodes that extend such that each of the discharge cells has a pair of bus electrodes arranged at outer areas thereof, and include protrusion electrodes arranged to extend from each of the bus electrodes such that a pair of opposing protrusion electrodes are arranged within areas corresponding to each discharge cell and wherein a gap is arranged between each opposing pair of protrusion electrodes.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Exemplary embodiments of the present invention will now be described in detail with reference to the accompanying drawings.

Figure 1:
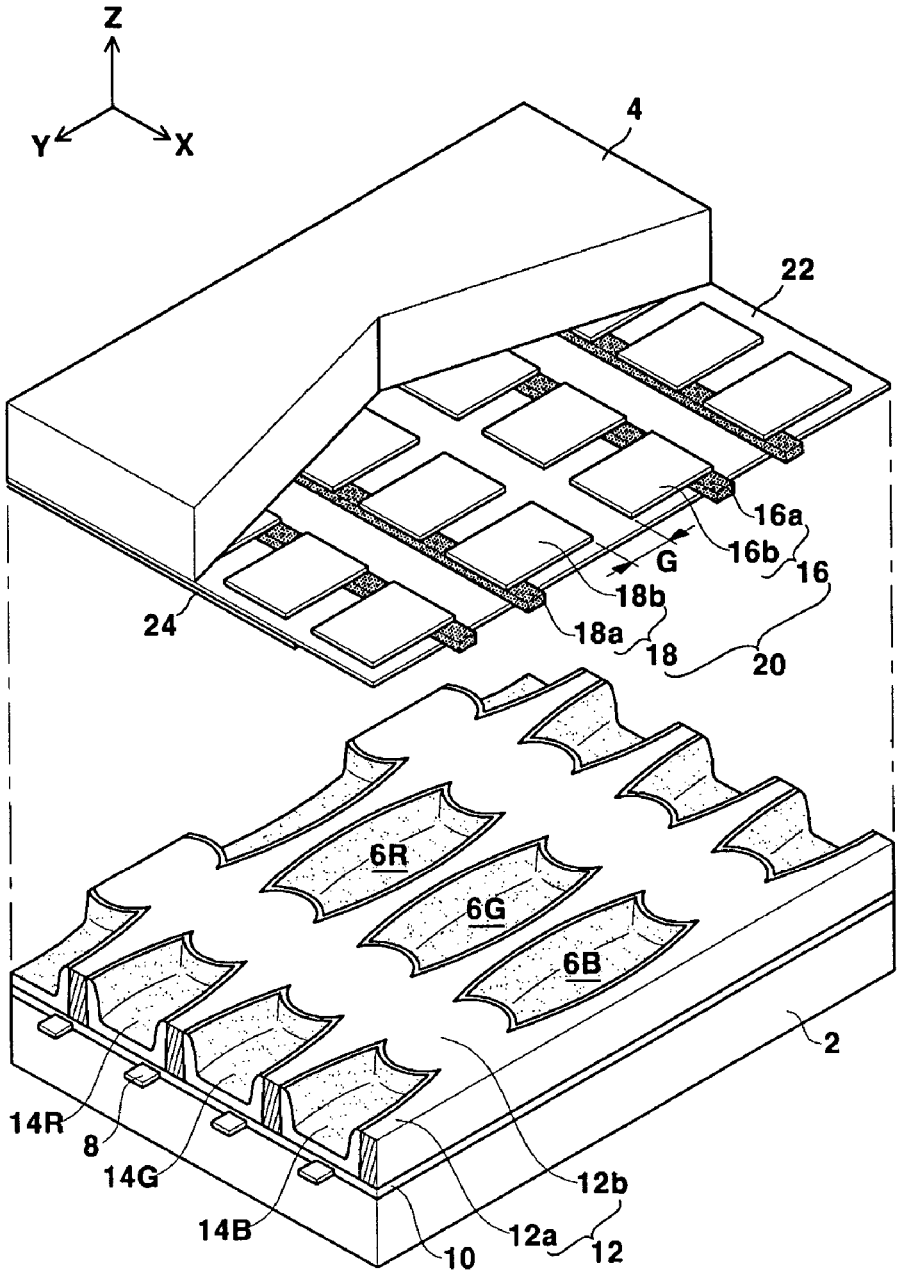
FIG. 1 is a partial exploded perspective view of a plasma display panel according to an exemplary embodiment of the present invention.
Figure 2:
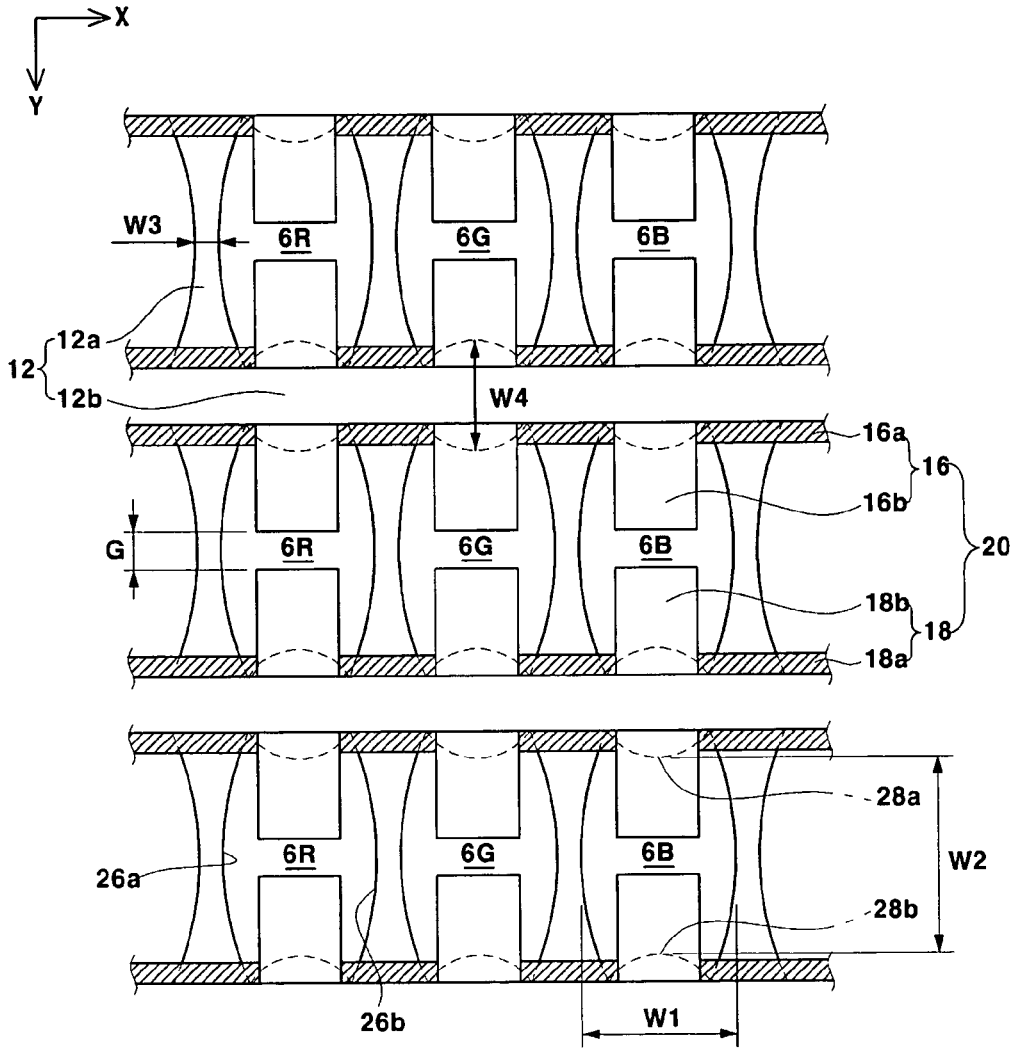
FIG. 2 is a partial plan view of the plasma display panel of FIG. 1 in an assembled state.
Figure 3:
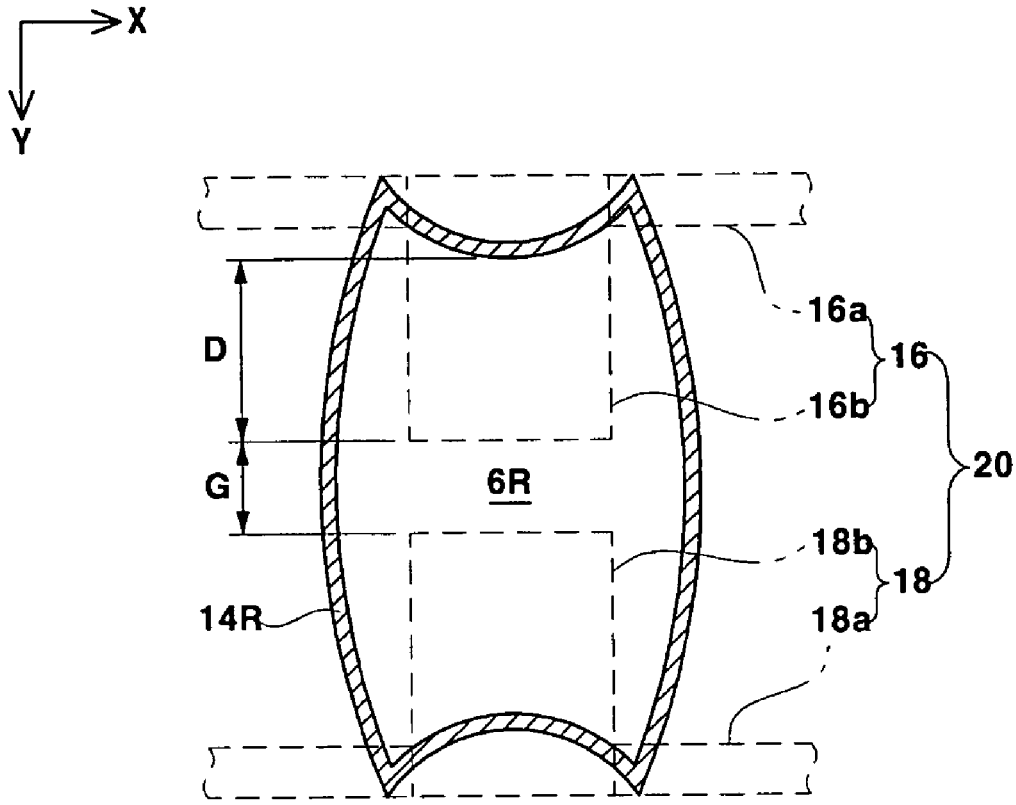
FIG. 3 is an enlarged view of a select area of FIG. 2.

FIG. 1 is a partial exploded perspective view of a plasma display panel (PDP) according to an exemplary embodiment of the present invention, FIG. 2 is a partial plan view of the PDP of FIG. 1 in an assembled state, and FIG. 3 is an enlarged view of a select area of FIG. 2.

In the PDP of the present invention, a first substrate 2 and a second substrate 4 are provided opposing one another with a predetermined gap therebetween. Discharge cells 6R, 6G, and 6B are arranged in the gap between the first and second substrates 2 and 4, and predetermined color images are realized by the emission of visible light effected by the independent discharge operation of each of the discharge cells 6R, 6G, and 6B.

In more detail, address electrodes 8 are arranged on an inner surface of the first substrate 2 opposing the second substrate 4. The address electrodes 8 are arranged along one direction (direction Y). As an example, the address electrodes 8 are arranged in a striped pattern with a predetermined spacing between adjacent address electrodes 8. A first dielectric layer 10 is arranged over an entire inner surface of the first substrate 2 covering the address electrodes 8.

Barrier ribs 12 are arranged on the first dielectric layer 10. The barrier ribs 12 are arranged in a lattice configuration including first barrier rib members 12*a* arranged substantially along the same direction as the address electrodes 8, and second barrier rib members 12*b* arranged substantially perpendicular to the first barrier rib members 12*a*. With this structure of the barrier ribs 12, each of the discharge cells 6R, 6G, and 6B is independently defined. The first barrier rib members 12*a* are positioned between the address electrodes 8. Red, green, and blue phosphor layers 14R, 14G, and 14B are arranged along all inner walls of the barrier ribs 12 and on areas of the first dielectric layer 10 within the discharge cells 6R, 6G, and 6B.

Sustain electrodes 20 are arranged on a surface of the second substrate 4 facing the first substrate 2 and along a direction substantially perpendicular to the address electrodes 8 (direction X) The sustain electrodes 20 include scan electrodes 16 and common electrodes 18. A transparent second dielectric layer 22 is arranged over an entire inner surface of the second substrate 4 to cover the sustain electrodes 20, and an MgO protection layer 24 is arranged to cover the second dielectric layer 22.

The scan electrodes 16 and the common electrodes 18 include bus electrodes 16*a* and 18*a* arranged in a direction substantially perpendicular the address electrodes 8. The bus electrodes 16*a* and 18*a* extend along extreme opposite ends of the discharge cells 6R, 6G, and 6B. The scan electrodes 16 and the common electrodes 18 also include protrusion electrodes 16*b* and 18*b*. The protrusion electrodes 16*b* and 18*b* are arranged such that for each of the discharge cells 6R, 6G, and 6B, there is one protrusion electrode 16*b* extending into the particular discharge cell 6R, 6G, or 6B from the corresponding bus electrode 16*a*, and one protrusion electrode 18*b* extending into the particular discharge cell 6R, 6G, or 6B from the corresponding bus electrodes 18*a*. A gap G is arranged between each opposing pair of protrusion electrodes 16*b* and 18*b* in each of the discharge cells 6R, 6G, and 6B. In one embodiment, the bus electrodes 16*a* and 18*a* are made of a low resistance metal material containing aluminum (Al) or copper (Cu), and the protrusion electrodes 16*b* and 18*b* are made of a transparent material such as indium tin oxide (ITO).

The first substrate 2 and the second substrate 4 structured as above are assembled and a discharge gas (typically an Ne—Xe compound gas) is injected into the discharge cells 6R, 6G, and 6B.

For purposes of explanation and with reference to FIG. 2, opposing sides of each of the discharge cells 6R, 6G, and 6B arranged substantially along the direction of the address electrodes 8 (direction Y) are referred to as a first side 26*a* and a second side 26*b*, and opposing sides of each of the discharge cells 6R, 6G, and 6B arranged substantially along the direction perpendicular to the address electrodes 8 (direction X) are referred to as a third side 26*c* and a fourth side 26*d*. The first and second sides 26*a* and 26*b* are convexly arranged in a direction away from each other about a center of each of the discharge cells 6R, 6G, and 6B. The third and fourth sides 26*c* and 26*d* are concavely arranged in a direction toward each other about the center of each of the discharge cells 6R, 6G, and 6B.

Stated differently, a first width W1 along the direction of the sustain electrodes 20 (direction X) of each of the discharge cells 6R, 6G, and 6B is at a maximum in the center areas of the discharge cells 6R, 6G, and 6B. The first width W1 increasingly reduces in size toward ends of the discharge cells 6R, 6G, and 6B. That is, the first width W1 increasingly reduces in size in a direction away from the centers of the discharge cells 6R, 6G, and 6B. A second width W2 along the direction of the address electrodes 8 of each of the discharge cells 6R, 6G, and 6B is at a minimum at the center areas of the discharge cells 6R, 6G, and 6B, and increasingly expands in size in the direction of the first and second sides 26*a* and 26*b*.

Such a configuration of the first and second sides 26*a* and 26*b* results in the center areas of the discharge cells 6R, 6G, and 6B, where sustain discharge is initiated and where the gaps G are formed, to be enlarged. The formation of the third and fourth sides 28*a* and 28*b* as described above is such that a distance D (see FIG. 3), between the gaps G and at least a portion of the phosphor layers 14R, 14G, and 14B located in extreme outer areas of the discharge cells 6R, 6G, and 6B, is reduced.

In one embodiment, the first and second sides 26*a* and 26*b* are arc-shaped in a direction away from the centers of the discharge cells 6R, 6G, and 6B, and the third and fourth sides 28*a* and 28*b* are arc-shaped in a direction toward the centers of the discharge cells 6R, 6G, and 6B. That is, the centers (or apexes) of the formed arcs are substantially aligned with the centers of the discharge cells 6R, 6G, and 6B.

The barrier ribs 12 are arranged in the following manner such that the discharge cells 6R, 6G, and 6B have the shape described above. In particular, the first barrier rib members 12*a* have a third width W3 that is at its minimum at areas corresponding to the centers of the discharge cells 6R, 6G, and 6B. The third width W3 increases in size as the distance from the centers of discharge cells 6R, 6G, and 6B is increased. The second barrier rib members 12*b*, on the other hand, have a fourth width W4 that is at its maximum at areas corresponding to the centers of the discharge cells 6R, 6G, and 6B. The fourth width W4 decreases in size as the first and second sides 26*a* and 26*b* of the discharge cells 6R, 6G, and 6B are approached.

Using the red discharge cell 6R shown in FIG. 3 as an example to describe the operation of all of the discharge cells 6R, 6G, and 6B, if an address voltage Va is applied between corresponding address electrode 8 (not shown in FIG. 3) and the scan electrode 16, an address discharge occurs in the discharge cell 6R. The result of the address discharge is that a wall charge accumulates on the second dielectric layer 22 that covers the sustain electrodes 20 to thereby select the discharge cell 6R.

A sustain voltage Vs is applied to the scan electrode 16 and the common electrode 18 of the selected discharge cell 6R. As a result, a plasma discharge (i.e., a sustain discharge) occurs starting in the discharge gap G between the opposing protrusion electrodes 16*b* and 18*b*. The plasma discharge then spreads to the peripheries of the discharge cell 6R. Ultraviolet rays are emitted from the excited Xe atoms created during the plasma discharge, and the ultraviolet rays excite the phosphor layer 14R so that it emits visible light. Predetermined images are realized by performing this operation in a deliberate, selective manner over the entire PDP.

As described above, the first and second sides 26*a* and 26*b* of the discharge cells 6R, 6G, and 6B are arranged such that the center areas thereof, where a sustain discharge is initiated and where the gaps G are formed, are enlarged. Therefore, a sustain discharge is easily initiated, and sufficient space charges are generated in the discharge cells 6R, 6G, and 6B to increase the strength of discharge.

Furthermore, the third and fourth sides 28*a* and 28*b* of the discharge cells 6R, 6G, and 6B are arranged convexly toward centers of the same as described above such that the distance D between the gaps G and at least a portion of the phosphor layers 14R, 14G, and 14B, located in extreme outer areas of the discharge cells 6R, 6G, and 6B, is reduced. Therefore, when a plasma discharge that is initiated in the discharge gaps G generates ultraviolet rays and spreads to the exterior areas of the discharge cells 6R, 6G, and 6B, paths along which the ultraviolet rays travel to reach the phosphor layers 14R, 14G, and 14B are shortened, and the strength of the ultraviolet rays is increased to thereby enhance the illumination efficiency and screen brightness.

Figure 4:
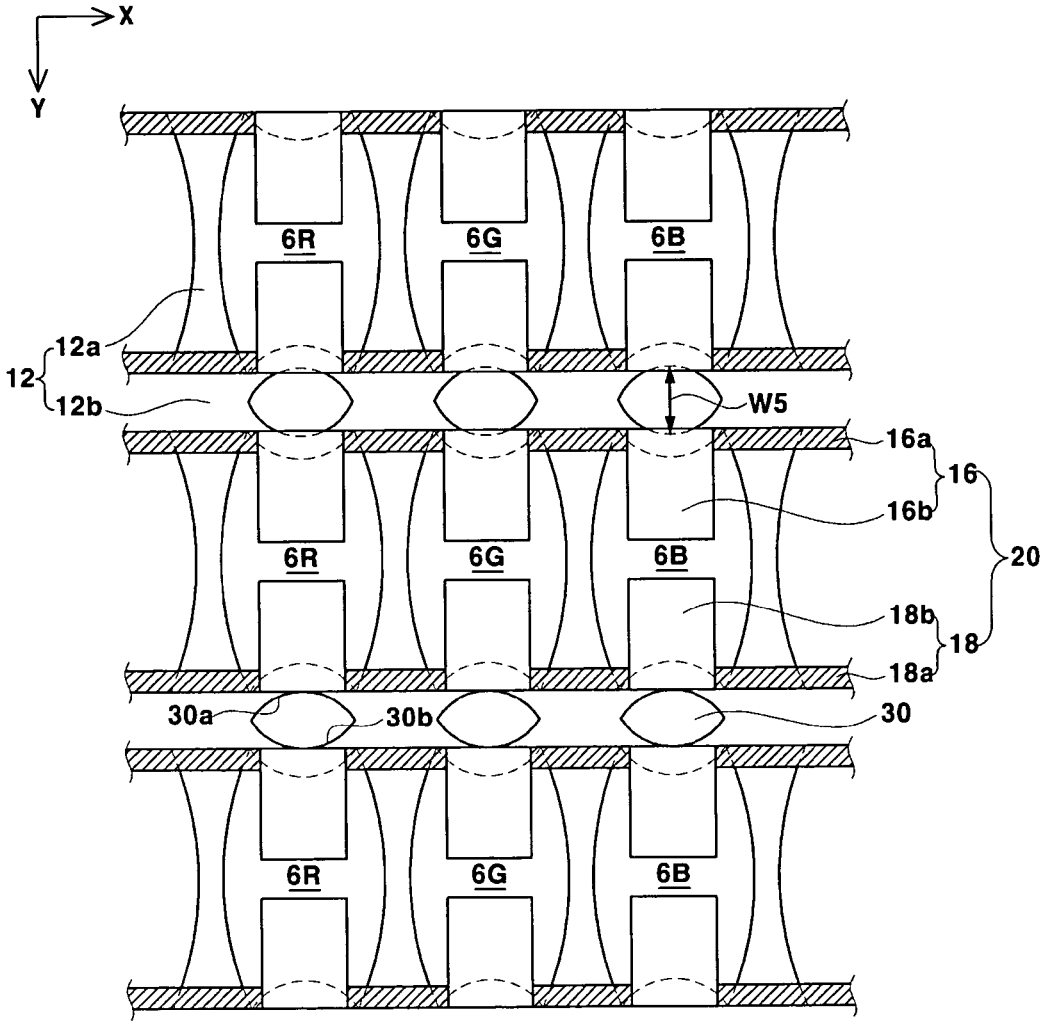
FIG. 4 is a partial plan view of a plasma display panel according to another exemplary embodiment of the present invention.

FIG. 4 is a partial plan view of a plasma display panel according to another exemplary embodiment of the present invention.

Using the basic configuration of the exemplary embodiment discussed above, non-discharge regions 30 are arranged between the discharge cells 6R, 6G, and 6B that are adjacent to each other along the direction of the address electrodes 8. The non-discharge regions 6 are areas where a gas discharge and illumination are not expected to take place. The non-discharge regions 6 also absorb the heat emitted from the discharge cells 6R, 6G, and 6B, and expel the heat to outside the PDP, thereby enhancing the heat-emitting efficiency of the PDP.

The non-discharge regions 30 are arranged corresponding to the general shape of the second barrier rib members 12*b* in the areas between the discharge cells 6R, 6G, and 6B that are adjacent in the direction of the address electrodes 8. In particular, with each of the non-discharge regions 30 being positioned between pairs of discharge cells 6R, 6G, and 6B that are adjacent along the direction of the address electrodes 8, each of the non-discharge regions 30 is defined by a first surface 30*a* adjacent to one of the discharge cells 6R, 6G, and 6B comprising one of a particular pair, and by a second surface 30*b* adjacent to the other of the pair of discharge cells 6R, 6G, and 6B. The first and second surfaces 30*a* and 30*b* are arc-shaped, with the arcs being arranged in a direction away from each other and the ends of the first and second surfaces 30*a* and with 30*b* being connected.

If W5 is a fifth width of the non-discharge regions 30 in the direction of the address electrodes 8, the fifth width W5 of each of the non-discharge regions 30 is at its maximum at a center area thereof, and decreases steadily, such as continuously, until the ends of the first and second surfaces 30*a* and 30*b* meet.

In the PDP of the present invention described above, the main area of discharge is enlarged by the formation of the first and second sides 26*a* and 26*b* such that sufficient space charges are generated in the discharge cells 6R, 6G, and 6B to increase the strength of discharge. Furthermore, the third and fourth sides 28*a* and 28*b* of the discharge cells 6R, 6G, and 6B are arranged such that the distance D between the gaps G and at least a portion of the phosphor layers 14R, 14G, and 14B, located in extreme outer areas of the discharge cells 6R, 6G, and 6B, is reduced to enhance the illumination efficiency and screen brightness. As a result, power consumption is reduced and screen brightness is increased such that PDP efficiency (the brightness ratio relative to power consumed) is increased.

Although the present invention has been described in detail above in connection with exemplary embodiments thereof, it should be understood that the present invention is not limited to the disclosed exemplary embodiments, but on the contrary, is intended to cover various modifications and/or equivalent arrangements included within the spirit and scope of the present invention, as recited in the appended claims.

What is claimed is:

1. A plasma display panel, comprising:

first and second substrates arranged to oppose one another with a predetermined gap therebetween;

address electrodes arranged on a surface of the first substrate to oppose the second substrate;

barrier ribs arranged between the first and second substrates in closed configurations to independently define discharge cells;

phosphor layers arranged within each of the discharge cells; and sustain electrodes arranged on a surface of the second substrate to oppose the first substrate, the sustain electrodes being arranged perpendicular to the address electrodes;

wherein each of the discharge cells includes first and second sides arranged along the direction of the address electrodes, and third and fourth sides arranged along the direction of the sustain electrodes, and wherein the first and second sides are convexly arranged in a direction away from each other and about centers of the discharge cells, and wherein the third and fourth sides are concavely arranged in a direction toward each other and about the centers of the discharge cells.

2. The plasma display panel of claim 1, wherein the first and second sides are arc-shaped in a direction away from centers of the discharge cells, and apexes of the arranged arcs are aligned with the centers of the discharge cells.

3. The plasma display panel of claim 1, wherein the third and fourth sides are arc-shaped in a direction toward centers of the discharge cells, and apexes of the arranged arcs are aligned with the centers of the discharge cells.

4. The plasma display panel of claim 2, wherein the third and fourth sides are arc-shaped in a direction toward centers of the discharge cells, and apexes of the arranged arcs are aligned with the centers of the discharge cells.

5. The plasma display panel of claim 1, further comprising non-discharge regions arranged between adjacent discharge cells in a direction of the address electrodes.

6. The plasma display panel of claim 1, wherein the sustain electrodes include bus electrodes that extend such that each of the discharge cells has a pair of bus electrodes arranged at outer areas thereof, and wherein the sustain electrodes include protrusion electrodes that extend from each of the bus electrodes such that a pair of opposing protrusion electrodes are arranged within areas corresponding to each discharge cell and such that a gap is arranged between each opposing pair of protrusion electrodes.

7. A plasma display panel, comprising:

first and second substrates arranged to oppose one another with a predetermined gap therebetween;

address electrodes arranged on a surface of the first substrate to oppose the second substrate;

barrier ribs arranged between the first and second substrates in closed configurations to independently define discharge cells;

phosphor layers arranged within each of the discharge cells; and sustain electrodes arranged on a surface of the second substrate to oppose the first substrate, the sustain electrodes being arranged perpendicular to the address electrodes;

wherein each of the discharge cells has a first width along the direction of the sustain electrodes, and a second width along the direction of the address electrodes, and wherein the first width continuously decreases as a distance from a center of the discharge cell is increased, and wherein the second width continuously increases as a distance from the center of the discharge cell is increased.

8. The plasma display panel of claim 7, further comprising non-discharge regions arranged between adjacent discharge cells in a direction of the address electrodes.

9. The plasma display panel of claim 8, wherein each of the non-discharge regions is arranged between pairs of adjacent discharge cells along the direction of the address electrodes, and wherein each of the non-discharge regions is defined by a first surface adjacent to one of the discharge cells comprising one of a particular pair of discharge cells, and by a second surface adjacent to the other of the particular pair of discharge cells, the first and second surfaces being convexly arranged in a direction away from each other.

10. The plasma display panel of claim 9, wherein the first and second surfaces are arc-shaped with apexes of the arcs of each of the non-discharge regions being respectively directed toward centers of the corresponding pair of discharge cells.

11. The plasma display panel of claim 8, wherein a width of the non-discharge regions in the direction of the address electrodes is at a maximum at a center area thereof, and decreases in a direction away from the center area along the direction of the sustain electrodes.

12. The plasma display panel of claim 7, wherein the sustain electrodes include bus electrodes that extend such that each of the discharge cells has a pair of bus electrodes arranged at outer areas thereof, and include protrusion electrodes arranged to extend from each of the bus electrodes such that a pair of opposing protrusion electrodes are arranged within areas corresponding to each discharge cell and wherein a gap is arranged between each opposing pair of protrusion electrodes.

* * * * *